US009562726B1

(12) United States Patent
Eplee

(10) Patent No.: US 9,562,726 B1
(45) Date of Patent: Feb. 7, 2017

(54) COUNTER-FLOW MEMBRANE PLATE EXCHANGER AND METHOD OF MAKING

(76) Inventor: Dustin Eplee, Boalsburg, PA (US)

( * ) Notice: Subject to any disclaimer, the term of this patent is extended or adjusted under 35 U.S.C. 154(b) by 1254 days.

(21) Appl. No.: 12/658,657

(22) Filed: Feb. 12, 2010

(51) Int. Cl.
*F28D 21/00* (2006.01)
*F28D 9/00* (2006.01)

(52) U.S. Cl.
CPC ..... *F28D 21/0015* (2013.01); *F28D 9/0025* (2013.01)

(58) Field of Classification Search
CPC ..... F28D 21/0015; F28D 9/0025
USPC ..... 165/54, 166, 167
See application file for complete search history.

(56) References Cited

U.S. PATENT DOCUMENTS 3,347,007 A * 10/1967 Hale ..... 52/380
4,460,388 A * 7/1984 Fukami et al. ..... 165/166
6,068,771 A * 5/2000 McDermott et al. .... 210/321.83
6,644,535 B2 * 11/2003 Wallach et al. ..... 228/173.5
6,684,943 B2 * 2/2004 Dobbs et al. ..... 165/166
8,157,891 B2 * 4/2012 Montie et al. ..... 95/43
8,486,178 B2 * 7/2013 Montie et al. ..... 165/166
2007/0185222 A1 * 8/2007 Shelton ..... 521/142
2008/0085437 A1 * 4/2008 Dean et al. ..... 429/26
2013/0248160 A1 * 9/2013 Eplee ..... 165/165

* cited by examiner

*Primary Examiner* — Devon Russell
(74) *Attorney, Agent, or Firm* — Richard K Thomson

(57) ABSTRACT

A counter-flow plate type exchanger is manufactured by repeatedly folding and joining at least two strips of membrane to form a counter-pleated core with a stack of openings or fluid passageways configured in an alternating counter-flow arrangement. Methods for manufacturing such counter-pleated cores are described. Counter-pleated cores comprising water-permeable membranes can be used in a variety of applications, including heat and water vapor exchangers. In particular, they can be incorporated into energy recovery ventilators (ERVs) for exchanging heat and water vapor between air streams directed into and out of buildings, automobiles, or other Industrial processes.

1 Claim, 12 Drawing Sheets

COUNTER-FLOW MEMBRANE PLATE EXCHANGER AND METHOD OF MAKING

FIELD OF THE INVENTION

The present invention relates to counter-pleated membrane plate exchangers and cross-pleated membrane spacers. More particularly the invention relates to exchangers in which the membrane and membrane spacer is folded, layered, and sealed in a particular manner. The invention includes a method for manufacturing such counter-flow membrane plate exchangers. In addition, it relates to a sinusoidal pattern netting separator material that is formed in a particular manner. The exchangers are useful in heat and water vapor exchangers and in other applications.

BACKGROUND OF THE INVENTION

Heat and water vapor exchangers (also sometimes referred to as humidifiers, enthalpy exchangers, or energy recovery wheels) have been developed for a variety of applications, including building ventilation (HVAC), medical and respiratory applications, gas drying or separation, automobile ventilation, airplane ventilation, and for the humidification of fuel cell reactants for electrical power generation. When constructing various devices intended for the exchange of heat and/or water vapor between two airstreams, it is desirable to have a thin, inexpensive material which removes moisture from one of the air streams and transfers that moisture to the other air stream. In some devices, it is also desirable that heat, as well as moisture be transferred across the thickness of material such that the heat and water vapor are transferred from one stream to the other while the air and contaminants within the air are not permitted to migrate.

Planar plate-type heat and water vapor exchangers use membrane plates that are constructed using discrete pieces of a planar, water-permeable membrane (for example, Nafion®, natural cellulose, sulfonated polymers or other synthetic or natural membranes) supported by a separator material (integrated into the membrane or, alternatively, remains independent) and/or frame. The membrane plates are typically stacked, sealed, and configured to accommodate fluid streams flowing in either cross-flow or counter-flow configurations between alternate plate pairs, so that heat and water vapor is transferred via the membrane, while limiting the cross-over or cross-contamination of the fluid streams.

One well known design for constructing heat exchangers employs a rotating wheel made of an open honeycomb structure. The open passages of the honeycomb are oriented parallel with the axis of the wheel and the wheel is rotated continuously on its axis. When this concept is applied to heat exchange for building ventilation, outside air is directed to pass through one section of the wheel while inside air is directed to pass in the opposite direction through another portion of the wheel. An energy recovery wheel typically exhibits high heat and moisture transfer efficiencies, but has undesirable characteristics including a fast rotating mass inertia (1-3 seconds per revolution), a high cross-contamination rate, high pollutant and odor carryover, a higher outdoor air correction factor than is ideal, a need for an electrical energy supply to power geared drive motors, and a need for frequent maintenance of belts and pulleys. Energy recovery wheel transfer efficiency correlates to the rotational speed of the device; spinning the wheel faster typically increases the energy transfer rate. However, any efficiency gained in this manner is offset by more negative effect of the undesirable characteristics here noted. Thus there is a need for a device that exhibits an energy transfer efficiency at least as great as an energy recovery wheel while minimizing these undesirable characteristics, especially the cross-contamination.

An energy recovery wheel processes large volumes of airflow in a relatively low volume footprint. By contrast, the size of a typical cross-flow and counter-flow plate-type exchanger design increases exponentially as the volume of processed airflow. As a plate-type exchanger increases in size, pressure drop across the exchanger also increases. Plate spacing on large plate-type exchangers is generally increased to mitigate pressure drop. The increase in plate spacing typically increases the overall volume of the exchanger relative to its design airflow. A further disadvantage is the incompatibility of existing plate-type exchangers to fit into existing air handling units designed to accommodate the relatively thin depth profiles of energy recovery wheels prohibiting retrofit replacement of a wheel by a typical plate-type exchanger.

Energy recovery wheels are typically customized for different end-use applications. The need for customization increases the end-use cost of the exchangers, material waste during manufacturing, design time, failure-testing costs, and a number of performance verification certifications. Energy recovery wheels require a wide variety of structural support sizes, lengths, and quantities and often competing design tradeoffs including number of segments, -wheel depths, motor sizes, belt lengths, and wheel speeds. In some HVAC systems, use of an energy recovery wheel may be prohibited due to the inherent risk of failure of the motor, belts, and seals.

Likewise, plate-type energy exchangers are typically customized for different end-use applications. The number and dimensions of cores are dictated by the end-use application. Manufacturing of plate-type exchangers requires the use of custom machinery, custom molds and various raw material sizes. Plate-type energy exchanger designs utilize a large number of joints and edges that need to be sealed; consequently, the manufacturing of such devices can be labor intensive as well as expensive. The durability of plate-type energy exchangers can be limited, with potential delaminating of the membrane from the frame and failure of the seals, resulting in leaks, poor performance, and cross-over contamination (leakage between streams).

In some heat and water vapor exchanger designs, the many separate membrane plates are replaced by a single membrane core made by folding a continuous strip of membrane in a concertina, zig-zag or accordion fashion, with a series of parallel alternating folds. Similarly, for heat exchangers, a continuous strip of material can be patterned with fold lines and folded along such lines to arrive at a configuration appropriate for heat exchange. By folding the membrane in this way, the number of edges that must be bonded can be greatly reduced. For example, instead of having to bond two edges per layer, it may be necessary only to bond one edge per layer because the other edge is a folded edge. However, the flow configurations that are achievable with concertina-style pleated membrane cores are limited, and there is still typically a need for substantial edge sealing, such as potting edges in a resin material. Another disadvantage is the higher pressure drop as a result of the often smaller size of the entrance and exit areas to the pleated core.

Existing cross-flow cores have theoretical efficiency limitations of approximately 80%, while the efficiency of a counter-flow core can theoretically reach 100%. Some current counter-flow plate type arrangements have achieved heat transfer efficiencies equal to or greater than energy recovery wheels, but incur the penalties of a much greater volume, higher pressure drop, and higher cost when compared to a recovery wheel. A broad array of shapes have been proposed in the prior art, including long rectangles, hexagonal profiles, and back-to-back cross flow designs. The existing counter-flow plate designs utilize a greater amount of material than their related cross-flow plate exchanger counterparts. In addition, current counter-flow plate designs generally transfer thermal energy only. Counter-flow heat and moisture plate-type exchangers have been expensive to produce due to inherent difficulty of the plate separation techniques, plate sealing, and inefficient use of materials.

While an energy recovery wheel transfers heat and moisture at nearly equal efficiencies, the existing membrane-type plate-exchangers have substantially reduced moisture transfer rates in comparison to thermal energy transfer. Attempts to increase vapor transmission have employed very expensive and specialized polymeric membranes, and have not seen wide spread practical use. This is partially due to spacer materials and membrane seam bonding that are impermeable to water vapor, effectively reducing the available surface area for water transport. In addition, specialized polymeric membranes transfer water vapor substantially in only one direction, perpendicular to the planar surface. Thus, spacing techniques blocking the effective surface area of one side of the membrane inherently inhibits the vapor transmission on the opposite side of the membrane.

OBJECTS OF THE INVENTION

It is, therefore, numbered among the objects of the present invention is to provide an improved counter-flow exchanger whose membranes are folded from continuous sheets (or rolls).

Another object of this invention is to provide an improved counter-flow exchanger whose separator material is formed from continuous corrugated netting sheets (or rolls).

A further object of this invention is to provide an improved method of constructing counter-flow exchangers whose membranes and separator materials are formed from continuous sheets.

A further object of this invention is to provide an improved bond between membranes utilizing thermal sealing techniques that produce a highly vapor permeable joint.

A further object of this invention is to provide an improved counter-flow exchanger that is resistant to all forms of corrosion.

A further object of this invention is to provide an improved separator material that allows airflow to pass bidirectionally without obstruction, thereby minimizing pressure drop and allowing for a broader array of geometric configurations.

A further object of this invention is to provide an improved counter-flow exchanger without the need for any potting resin.

A further object of this invention is to provide a modular/stackable counter-flow exchanger which can be readily incorporated and scaled into a larger wall and thus accommodate higher quantities of airflow.

A further object of this invention is to provide an exchanger with a smaller depth profile.

A further object of this invention is to provide an exchanger that is lighter weight and utilizes less material, thus reducing overall manufacturing costs.

SUMMARY OF THE INVENTION

The present approach provides a uniquely counter-pleated core that provides a stack or layered array of openings or fluid passageways, and that utilizes membrane folds for edge sealing. In preferred embodiments, the counter-pleated membrane core is manufactured using at least two strips of membrane. Each membrane strip undergoes a repeated folding process, incorporating also steps to join the two or more strips of membrane to form a layer and further joining the edges of layers to form seals. The resultant passageways are configured in alternating counter-flow arrangement.

In particular, a method for making a counter-pleated core having a plurality of membrane layers comprises positioning at least two membrane strips, extending in substantially opposite directions edge-to-edge, generally in the same plane. The strips are positioned so that a portion of one edge of one of the membrane strips is adjacent and substantially parallel to a portion of one edge of the other membrane strip. The adjacent edge portions of at least two membrane strips are joined, forming a first seam with additional membrane seams by joining adjacent edge portions of additional membrane strips. Each membrane strip is then reverse folded 180° in each of the at least two membrane strips to overlie the first membrane layer. A second membrane seam is formed by joining the first edge portion of first membrane strip to the adjacent second edge portion of second membrane strip of at least two membrane strips. Additional membrane seams are formed by joining adjacent edge portions of additional adjacent membrane strips to form a second membrane layer overlying the first membrane layer. The second membrane layer is parallel to and spaced from first membrane layer. The joining and folding steps are repeated to form a counter-pleated core with a stack or layered array of passageways between the membrane layers. The resultant counter-pleated cartridge can be formed from two or more continuous membrane strips and the number of folds can be varied to give cores with the desired number of layers.

In embodiments of the present method, adjacent portions of the membrane strips can be positioned so that they abut one another, or so that they slightly overlap, along the seams. They can be joined by various methods including: applying impulse style thermal bonding, or applying adhesive tape, or welding the edges of the membrane together along the seams.

A method for making a counter-pleated core further comprises potting the non-folded membrane layer edges with a sealant material.

A preferred method for making a counter-pleated core can further comprise steps in which the counter-pleated exchanger has two non-folded edges and a first and second adjacent membrane layer. In this configuration, one non-folded edge is sealed to a first adjacent membrane edge while the second non-folded edge is sealed to a first adjacent membrane edge while the second non-folded edge is sealed to a second adjacent membrane edge. The above mentioned embodiment can be achieved during the folding of counter-pleated core or after the folding of counter-pleated core is achieved.

Each of the membrane layers in the counter-pleated core will have a number of intersections between folded edges of membrane strips (the number of the intersections will depend upon the number of membrane strips used in the construction). A method for making a counter-pleated core can further comprise applying a sealant material at the intersecting folded edges of the membrane layers. For example, the sealing step can comprise potting the layered fold intersections (edges that are perpendicular to the membrane layers) of the core with a sealant material.

A method for making a counter-pleated core can further comprise inserting a separator between at least some of the plurality of membrane layers. Separators can be inserted either during the counter-pleating process, or into passageways of the core once the core is formed. In some embodiments the separator is used to define a plurality of discrete fluid flow channels within the passageway, for example, to enhance the flow of fluid streams across opposing surfaces of the membrane. Separators can also be used to provide support to the membrane, and/or to provide more uniform spacing of the layers.

The separators can be of various types, including corrugated, biaxially oriented netting of thermoplastic material whose sinusoidal shape defines a plurality of discrete fluid flow channels within the heat and water vapor exchanger. Biaxial orientation "stretches" extruded square mesh in one or both directions under controlled conditions to produce strong, flexible, light weight netting. Netting material is furthermore placed into a sinusoidal pattern through corrugating process. The membrane separator can further be selected from a group consisting of polypropylene and other thermoplastics having mesh sheet weight of less than 3 lbs/1000 $ft^2$ and preferably less than 1.5 lbs/1000 $ft^2$. Other potential types of separators for counter-pleated core include corrugated sheet materials, mesh materials, and molded plastic inserts.

A preferred method for making a counter-pleated core can further comprise inserting a continuous strip of separator material between at least some of the plurality of membrane layers during the counter-pleating membrane process. A continuous strip of separator material is cross-pleated, running-parallel to the counter-pleated folds forming 90° angle to membrane strip seams.

The present invention encompasses counter-pleated membrane cores that are obtained or are obtainable using embodiments of the methods described herein.

Counter-pleated membrane cores comprise multiple layers of folded membrane that define a stack or layered array of fluid passageways. Each layer comprises a portion of at least two strips of membrane joined edge-to-edge to form at least one seam. The seams in adjacent membrane layers of the core are oriented parallel to one another.

Counter-pleated membrane cores can be used in a variety of applications, including heat and water vapor exchangers. The cores are particularly suitable for use as cores in energy recovery ventilators (ERV) applications. They can also be used in heat and/or moisture applications, air filter applications, gas dryer applications, flue gas energy recovery applications, sequestering applications, gas/liquid separator applications, automobile outside air treatment applications, airplane outside air treatment applications, and fuel cell applications. Whatever the application, the core is typically disposed within some kind of housing.

An embodiment of a heat and water vapor exchanger, for transferring heat and vapor between a first fluid stream and a second fluid stream, the exchanger comprising: a housing with a first surface containing a first plurality of inlet ports and outlet ports, and a substantially parallel opposing second surface containing a second plurality of inlet ports and outlet ports. The first inlet ports on first surface are directly opposite second inlet ports on second surface and first outlet ports on first surface are directly opposite second outlet ports on second surface. A counter-pleated core is generally enclosed within a housing. The core comprises multiple layers of folded, water-permeable membrane material defining a stack of alternating first and second fluid passageways, wherein each layer comprises a portion of at least two strips of said water-permeable membrane material joined by one seam for a first pair of two strips and one additional seam for each additional strip. The seams joining membrane strips are subsequently internal within counter-pleated core and substantially parallel to a direction of general airflow movement. The folds of water-permeable membranes define inlet and outlet ports on first and second faces of counter-pleated core and being substantially perpendicular to seam(s). All first inlets on first face fluidly connect to all second outlets on second face and wherein all second inlets on the second face fluidly connect to all first outlets on the first face. Exchangers utilizing counter-pleated membranes and cross-pleated separators of the type described herein have enhanced sealing characteristics and reduced construction time. ERV cores comprising counter-pleated cores of this type described herein have given superior results in pressurized crossover leakage relative to conventional planar plate-type core designs. ERV cores comprising counter-pleated cores of this type described herein have given superior results in moisture transfer relative to conventional planar plate-type core designs.

Exchangers utilizing counter-pleated membranes and cross-pleated spacers of the type described herein have improved heat and/or moisture transfer efficiencies.

Exchangers utilizing counter-pleated membranes and cross-pleated spacers of the type described herein have reduced material costs and reduced construction time.

Exchangers utilizing counter-flow exchanger and related manifolding described herein utilize less depth, less volume, and are overall more compact to fit into existing HVAC equipment.

Exchangers utilizing this folding configuration are advantageous in that they reduce the number of edges that have to be sealed, especially relative to counter-flow plate-type heat and water vapor exchangers where individual pieces of membrane are stacked and have to be sealed along four edges.

Various other features, advantages, and characteristics will become apparent following a reading of the following detailed description.

BRIEF DESCRIPTION OF THE DRAWINGS

The subject matter which is regarded as the invention is set forth in the appended claims. The invention itself, however, together with further objects and advantages thereof may be better understood in reference to the accompanying drawings in which:

DESCRIPTION OF THE PREFERRED EMBODIMENTS

Figure 1A:
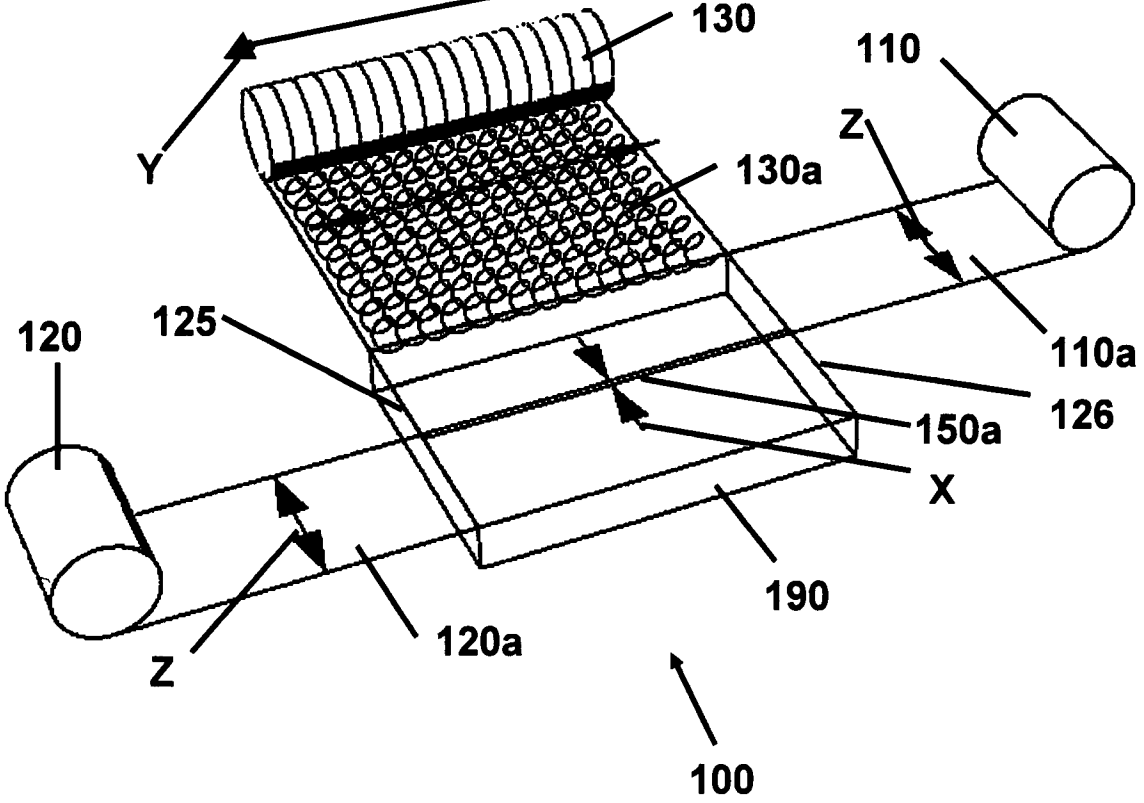
FIGS. 1*a-b* show simplified schematic diagrams illustrating a variety of starting positions and starting number of membrane strips that can be utilized to make a counter-pleated, counter-flow plate exchanger.
Figure 1B:
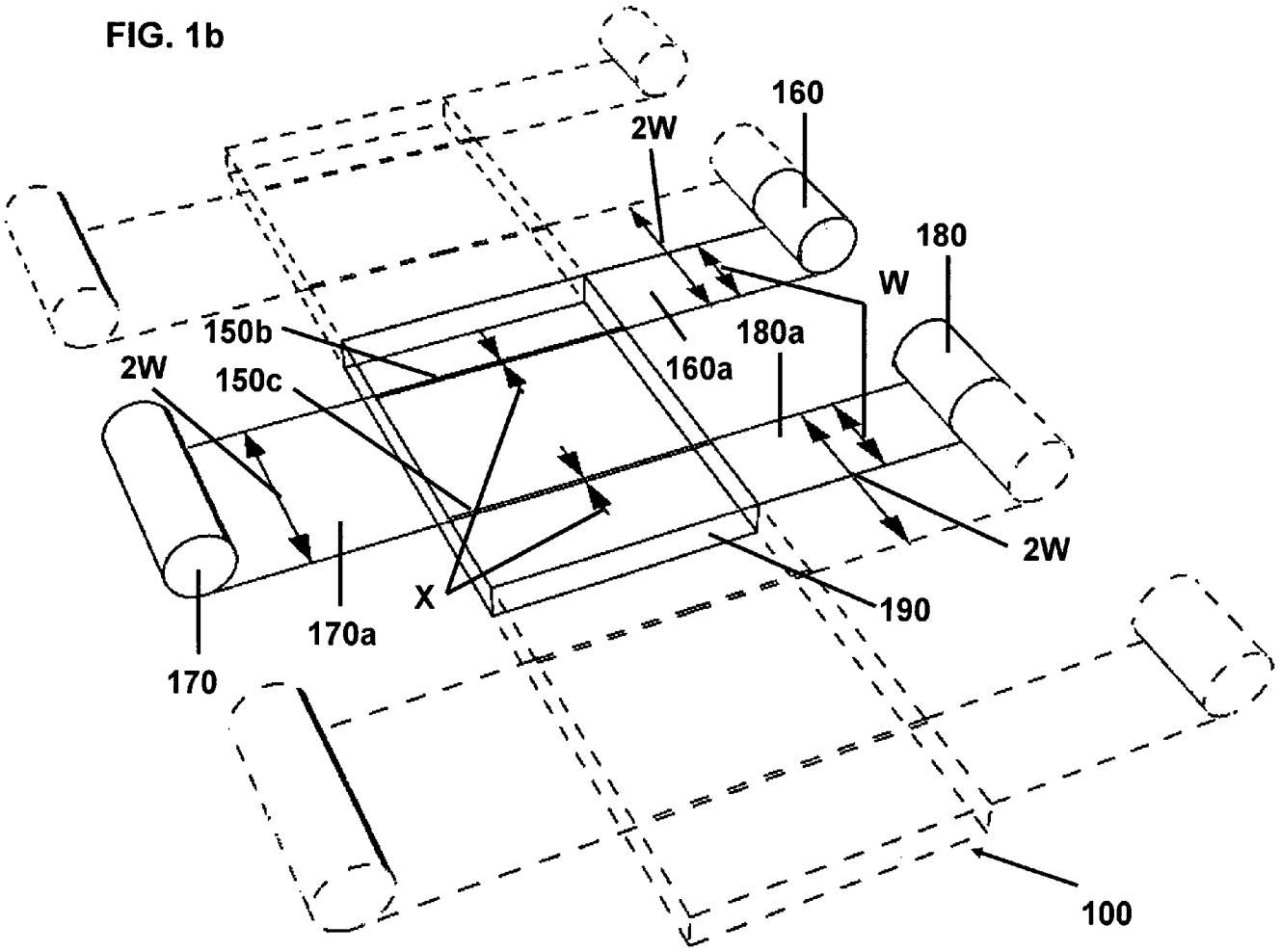

FIGS. 1*a-b* show simplified schematic diagrams illustrating a variety of starting positions and starting number of membrane strips that can be utilized to make a counter-pleated, counter-flow core 100. In FIG. 1*a* two strips of membrane 110*a* and 120*a* of width Z are drawn in substantially opposite directions from two reels of membrane, 110 and 120, respectively. Start of membrane 110*a* is produced by 90° angle cut 125. Start of membrane 120*a* is produced by 90° angle cut 126. Membrane strips 110*a* and 120*a* are arranged edge-to-edge in the same plane on the top surface of a base frame or platform 190. The resultant seam 150*a* forms an overlap of X distance. One strip of separator 130*a* is drawn at a 90° angle to strips 110*a* and 120*a* from reel of separator 130 of width Y. FIG. 1*b* illustrates a repeating pattern to start construction of a counter-pleated core 100. Three or more strips of membrane 160*a*, 170*a*, and 180*a* of width W or 2W are drawn in substantially opposite directions from two reels of membrane 160, 170, and 180, respectively. Multiple membrane strips 160*a*, 170*a*, and 180*a* are arranged edge-to-edge in the same plane on the top surface of a base frame or platform 190. Two or more resultant seams 150*b* and 150*c* form an overlap of X distance.

Figure 2A:
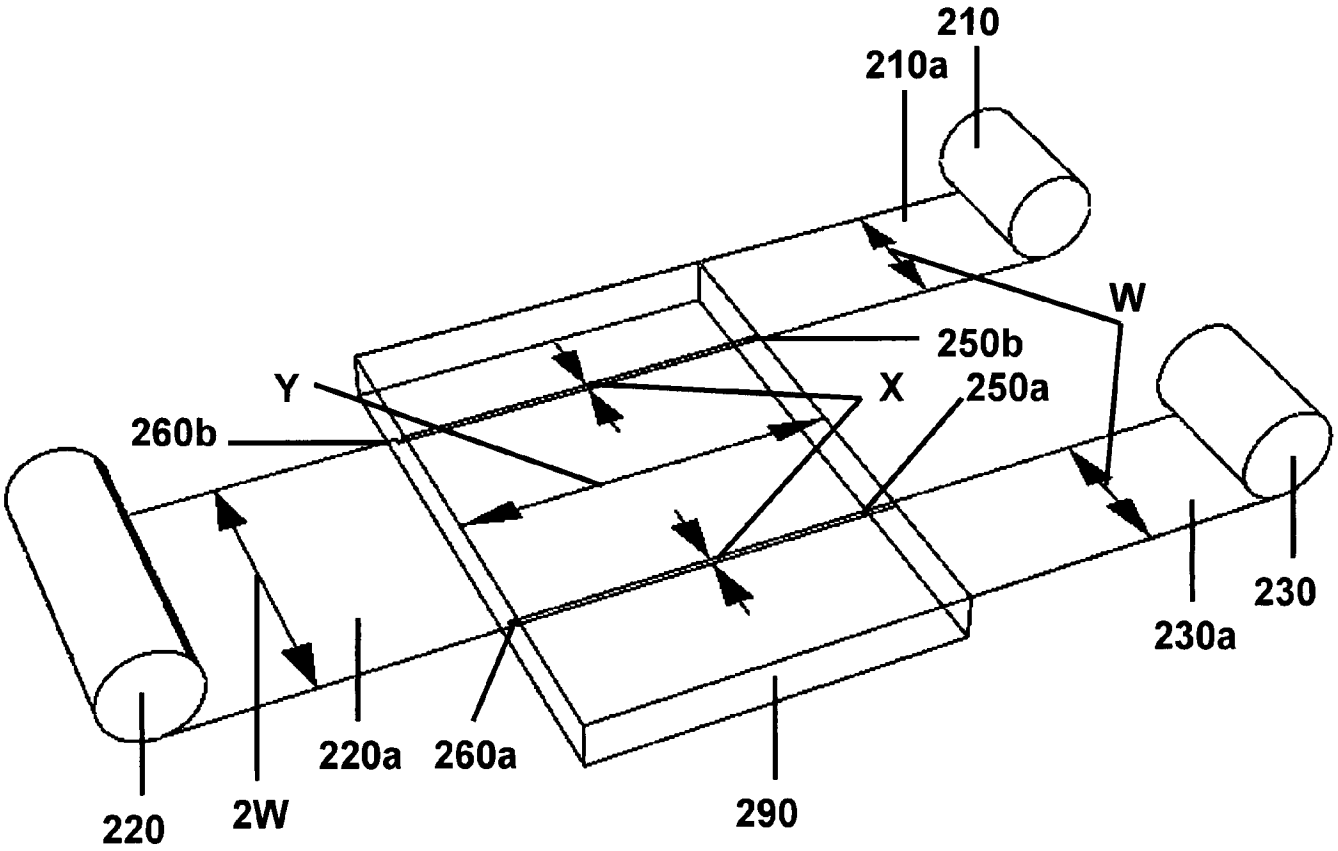
FIGS. 2*a-f* show a series of simplified schematic diagrams illustrating steps in a counter-pleating technique utilizing three (3) continuous membrane strips.
Figure 2B:
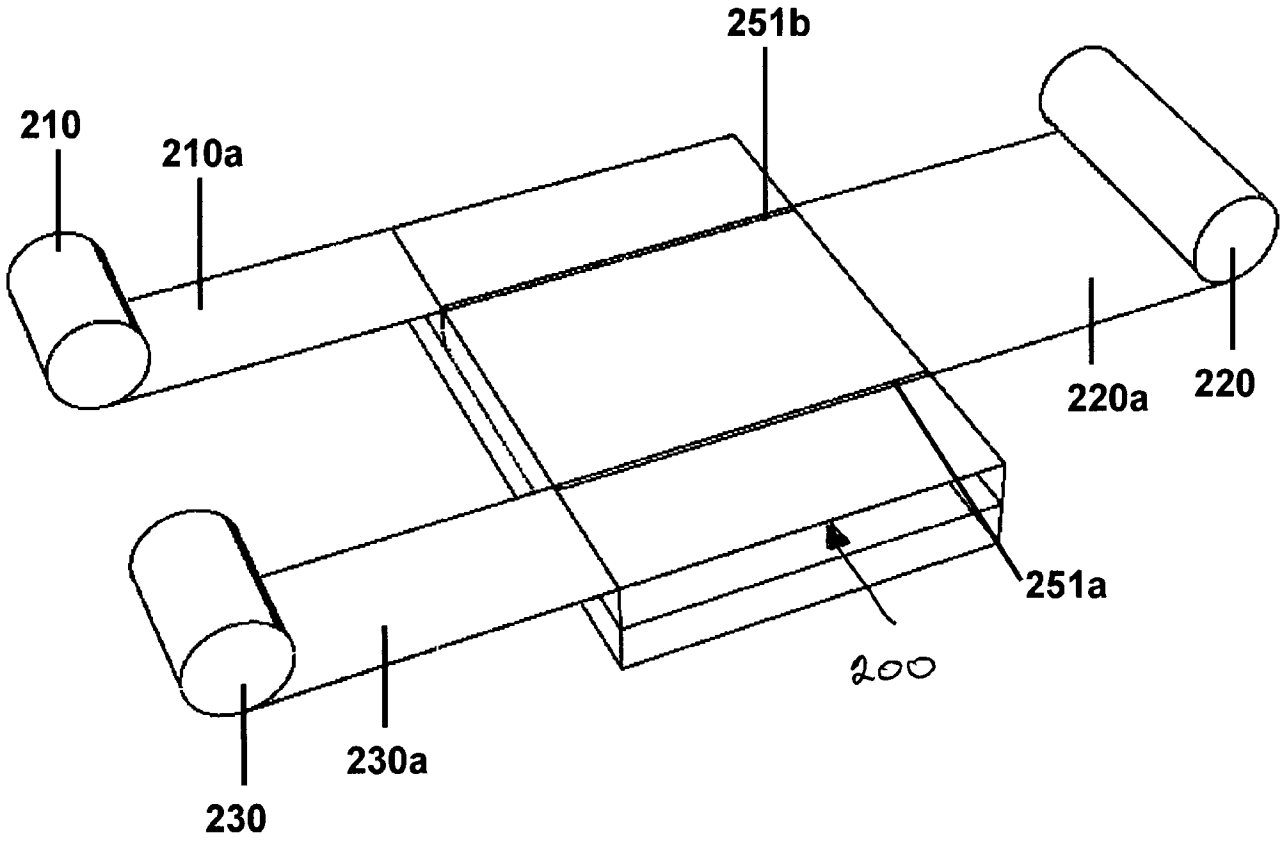

FIGS. 2*a-f* show a series of simplified schematic diagrams illustrating steps in a counter-pleating technique utilizing three (3) continuous membrane strips and cross-pleating technique utilizing one (1) continuous spacer strip. While the cross insertion of a separator layer has been omitted from the depiction for the sake of simplicity, it will be understood that the insertion of a separator strip 130*a* between each fold is within scope of the invention. In FIG. 2*a* three strips of membrane 210*a*, 220*a*, and 230*a* are drawn in substantially opposite directions from three reels of membrane 210, 220, and 230, respectively. Membrane strips 210*a* of width W, 220*a* of width 2W, and 230*a* of width W are arranged edge-to-edge in the same plane on the top surface of a base frame or platform 290. Resultant seam 250*b* of width X is between membrane strips 210*a* and 220*a* while the resultant seam 250*a* of width X is between membrane strips 230*a* and 220*a*. The edges of membrane strips 210*a* and 220*a* are joined together along seam 250*b* with length Y. The edges of membrane strips 230*a* and 220*a* are joined together along seam 250*a* with length Y.

Slits 260*b* and 260*a* of length Z are formed along the end of membrane strip 210*a* and end of membrane strip 230*a*, respectively. In the next step, shown completed in FIG. 2*b*, each membrane strip 210*a*, 220*a*, and 230*a* is reverse folded 180° to its edge, to overlie previous layer. Membrane strips 210*a*, 220*a*, and 230*a* are similarly arranged edge-to-edge in the same plane to overlie previous layer. Resultant seam 251*b* is between membrane strips 210*a* and 220*a* while resultant seam 251*a* is between membrane strips 230*a* and 220*a*. In the next step, shown completed in FIG. 2*c*, membrane edge 230*a* is joined to previous layer along parallel edge to form seam 270. Slits 261*b* and 261*a* are formed along the folded edge of membrane 210*a* and 230*a*, respectively. In the next step, shown completed in FIG. 2*d*, each membrane strip 210*a*, 220*a*, and 230*a* is similarly reverse folded 180° to its edge, to overlie previous layer. Membrane strips 210*a*, 220*a*, and 230*a* are similarly arranged edge-to-edge in the same plane to overlie previous layer. Resultant seam 252*b* is between membrane strips 210*a* and 220*a* while resultant seam 252*a* is between membrane strips 230*a* and 220*a*. In the next step, shown completed in FIG. 2*e*, membrane edge 210*a* is joined to previous layer along parallel edge to form seam 280. Slits 262*b* and 262*a* are formed along the folded edge of membrane 210*a* and 230*a*, respectively. The folding and joining process (shown in FIGS. 2*a-e*) is then repeated to give the desired number of layers in membrane core 200.

For the last layer of the core, the end of each membrane strip 210*a*, 220*a*, and 230*a* is trimmed at 90° to form the top surface of the core. The resulting counter-pleated core has layered alternating openings or passageways with a plurality of inlet ports and outlet ports on only two out of six faces of the core, thereby creating counter-flow or parallel airflow passageways. FIG. 2*f* shows a first divided fluid supplied to one face of the core 200 as indicated by arrows 201*a* and 202*a* that will pass through the layered passageways exiting together at the opposite face as indicated by arrows 201*b* and 202*b*. A second divided fluid is supplied to one face of the core 200 as indicated by arrows 203*a* and 204*a* that will pass through the layered passageways exiting together at the opposite face as indicated by arrows 203*b* and 204*b* in FIG. 2*f* This allows for the counter-flow configuration of two different fluids through alternating layers of the core.

Such cores can be manufactured in a wide variety of sizes and number of membrane strips. The height of the finished core will depend on the number of folded layers, as well as the thickness of the membrane and separator (if any) in each layer. A continuous folding operation could also be envisioned with core size selected and generally cut to any size specification.

Figure 2C:
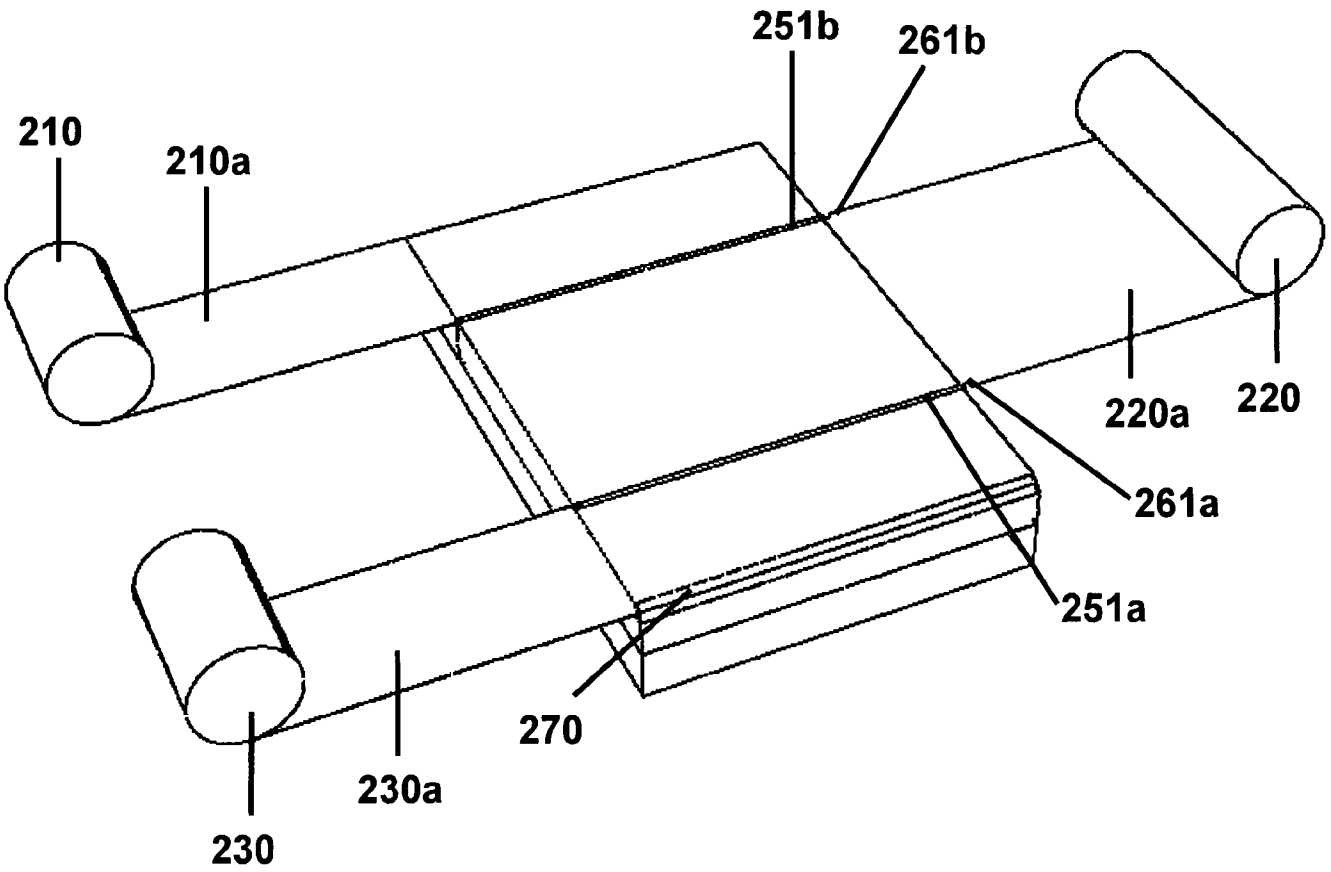
Figure 2D:
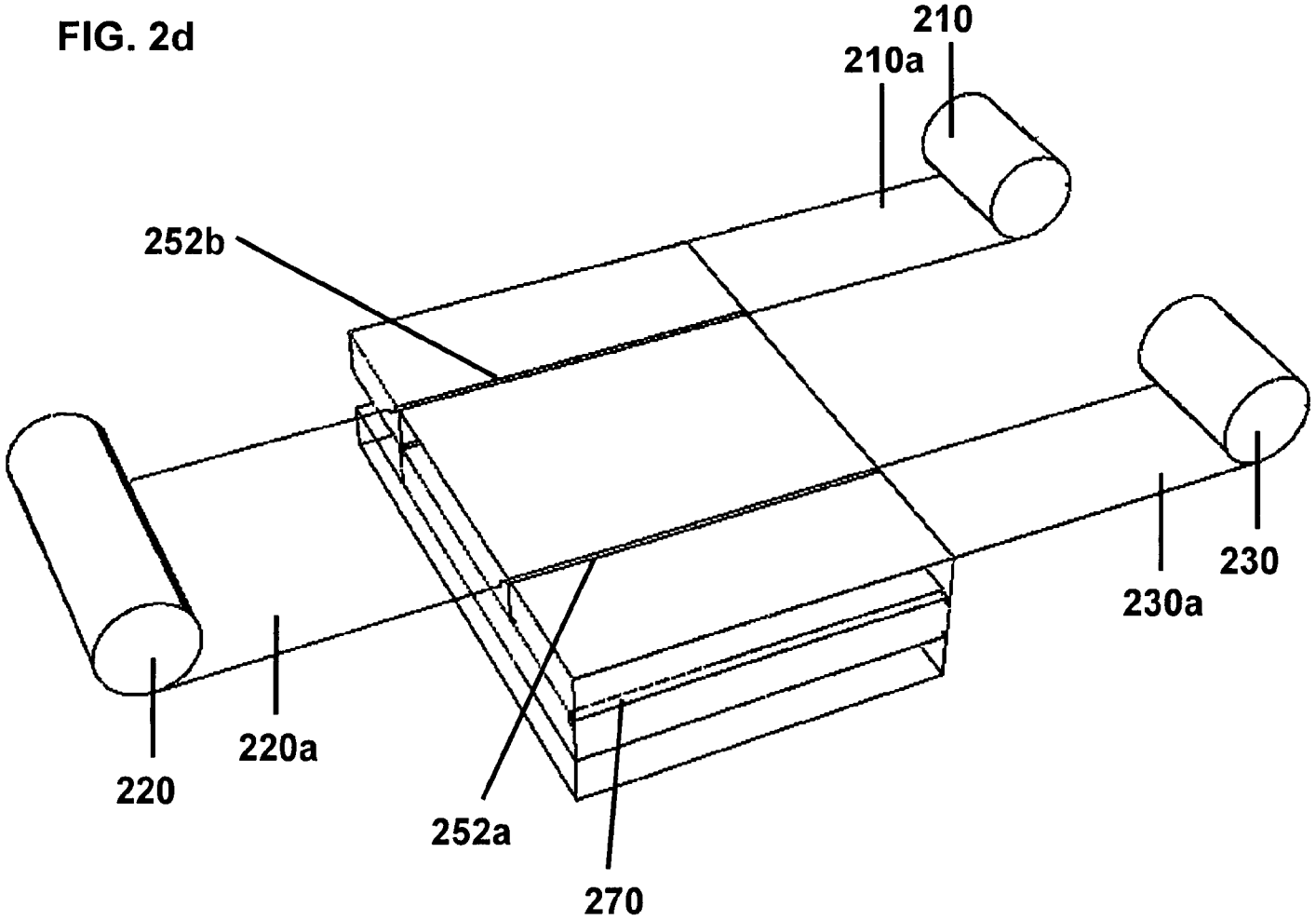
Figure 2E:
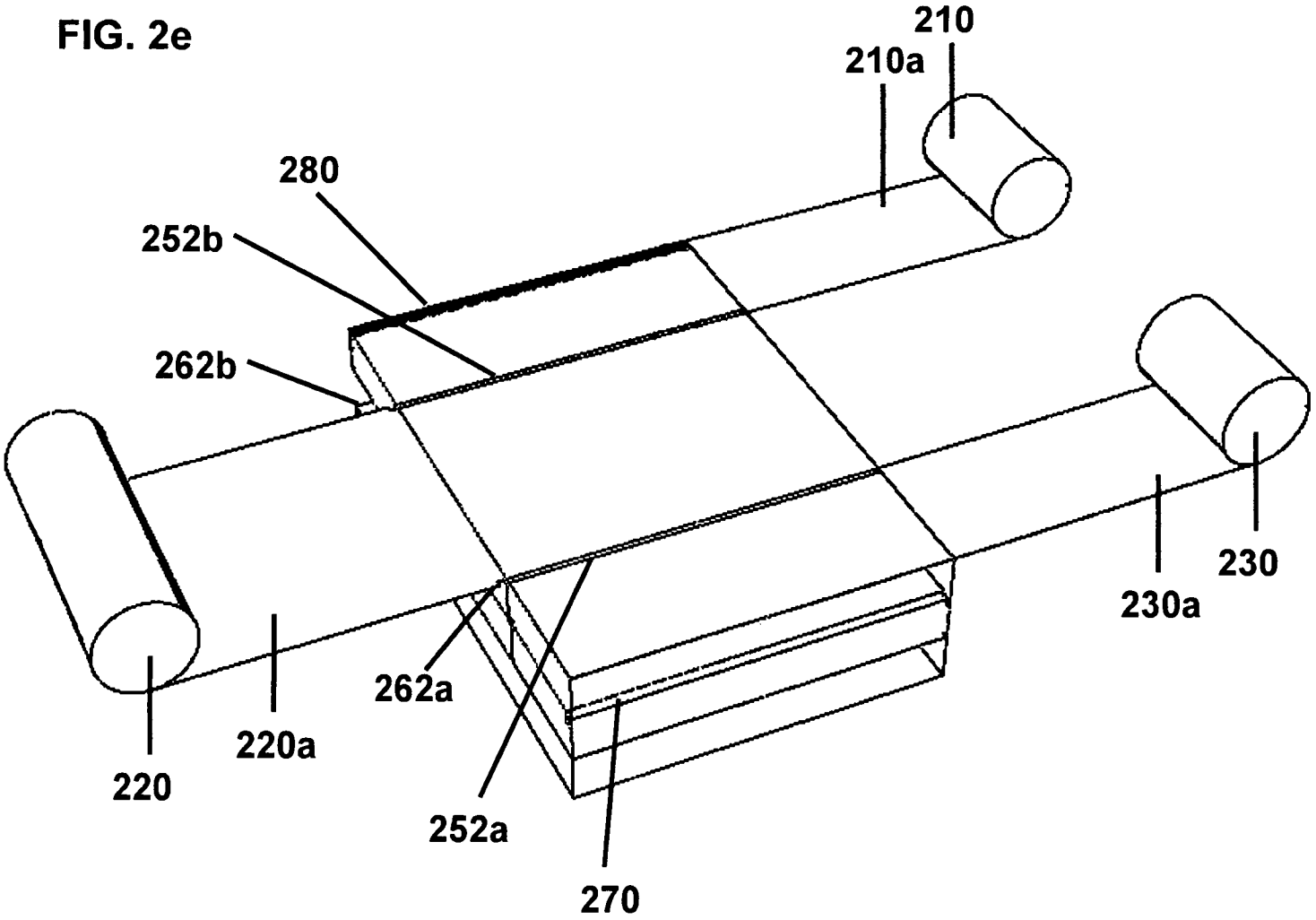
Figure 2F:
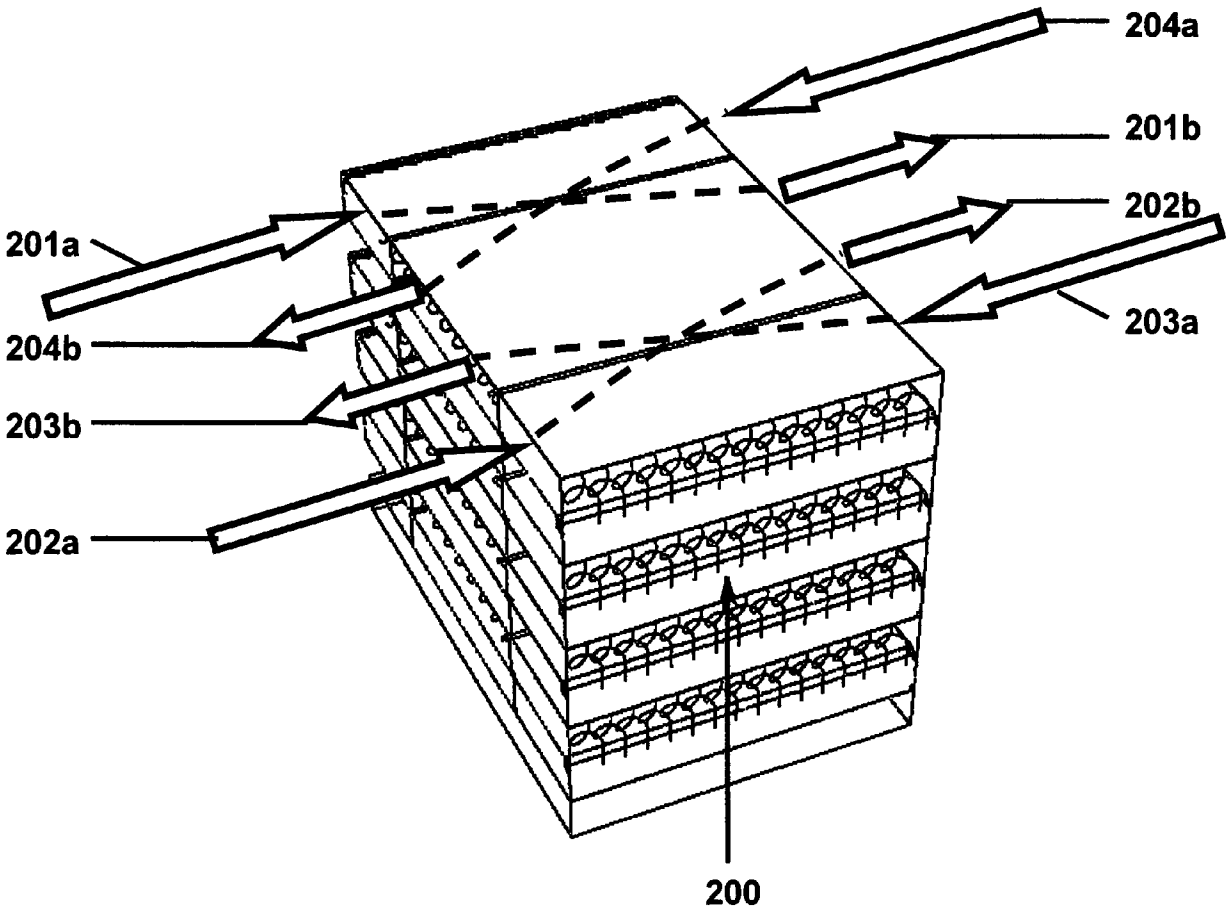

Various methods can be used to join the two or more strips of membrane along the in-plane seams (for example, 251*b* and 251*a* in FIG. 2*c*) and the edge seams between layers (for example, 270 in FIG. 2*c*). For example, the membrane strips can be thermally joined using impulse type heaters. Using this technique, back pressure would be utilized to create compression and then thermal energy applied. Depending on the membrane material, high strength seals have been produced with less than 1/16" overlap of the membranes. In preferred embodiments, slits (for example, 260*b* and 260*a* in FIG. 2*a*) found at the ends of edge seams in FIGS. 2*a-e* may be eliminated when membrane overlap distance X is minimal. A yielding in the membrane material may allow for membrane overlap without slits depending on the membrane material and method of joining. The membrane strips can also be joined together using a suitable adhesive tape, selected depending on the nature of the membrane and/or the end-use application for the core. If adhesive tape is used, the membrane edges preferably abut edge-to-edge. Thus, in FIG. 1*a* the overlap dimension X would be zero. Adhesive tape can be placed along the seam contacting each membrane strip and forming a seal. Preferably the tape is wide enough to adequately cover the seam and accommodate variability in the manufacturing process, without obscuring too much of the membrane surface. Depending on the properties of the membrane, the edges can instead be vibration welded together along the seams. For thermal bonding, vibration welding, or adhesive bonding, preferably the membrane roll width is slightly oversized so that the membrane edges can be overlapped slightly along the seams. Whatever method is used to join the membrane strips along the diagonal seams, preferably it forms a good seal so that fluids do not pass between layers via a breach or leak in the seam, causing undesirable mixing or cross-contamination of the process streams in the particular end-use application of the core.

In preferred embodiments, a counter-pleated core is provided with seals along corners of each fold produced by the counter-pleating process. In one approach these seals are formed with thermally activated glue, caulk, "potting" materials, or foam to form a seal between adjacent folded corners comprising each layer. The sealant will close off the holes created at the intersection between corners of each fold produced by the counter-pleating process, and select folds can also provide attachment to a framework by which the core is held together. The seals can be formed using a suitable material, for example a low smoke hot-melt adhesive specifically formulated for air filter applications, or a two-part rubber epoxy material can be used.

Figure 3A:
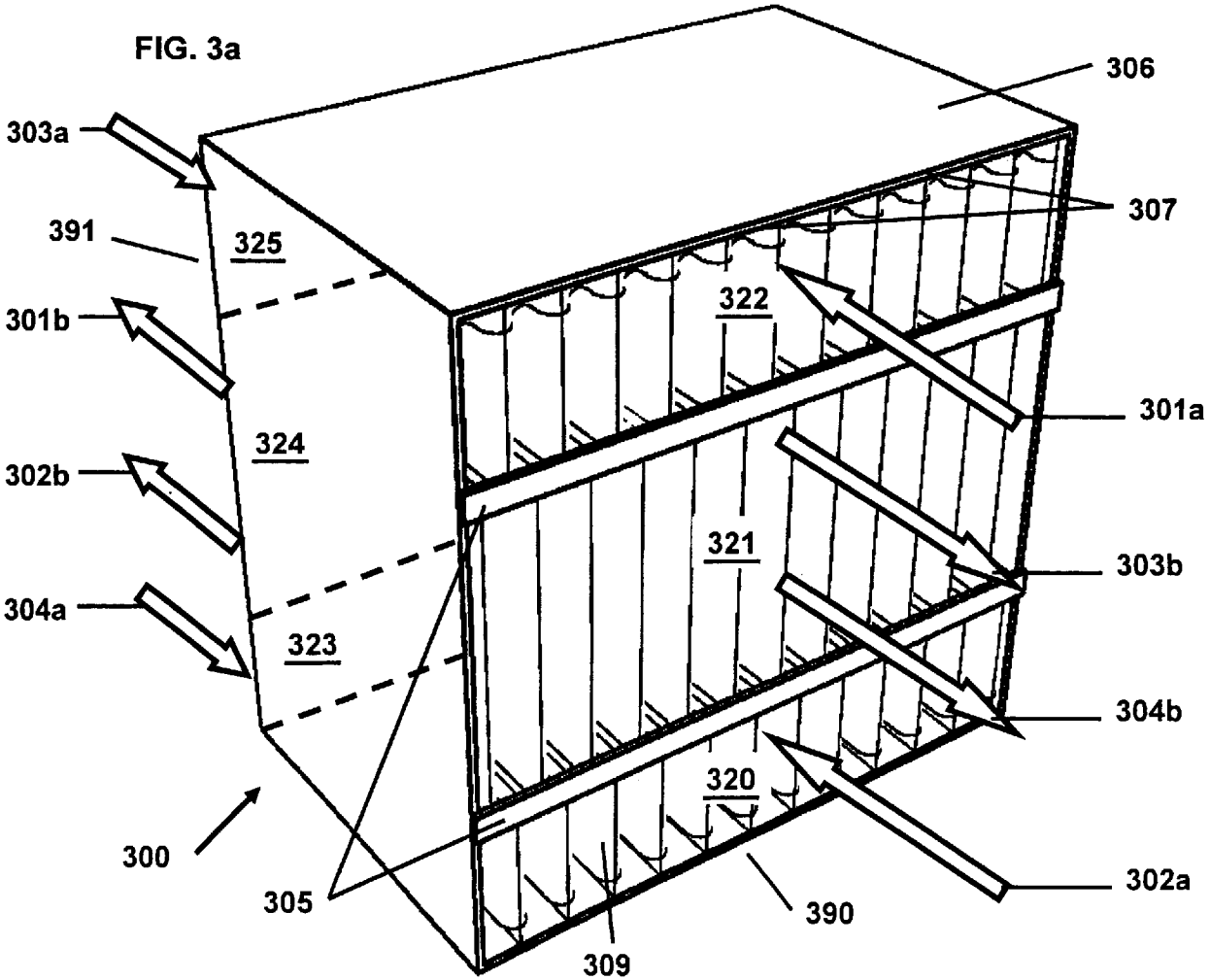
FIG. 3*a* illustrates counter-flow exchanger with air stream flows, air stream separation, and counter-pleated membrane housing structure.

In preferred embodiments, a counter-pleated core is also provided with seals along the start of membrane strips (for example, 125 and 126 in FIG. 1*a*) with adjoined housing and along the end of membrane strips with adjoined housing (306 in FIG. 3*a*, for example). Various methods can be used to seal the ends of the membrane strips to the housing. In one approach these seals are formed with folded mechanical clips, separate or apart of the counter-pleated housing. The ends of membrane strips could also be sealed to the counter-pleated core housing through suitable single sided adhesive tape, suitable double sided adhesive tape, caulk, two-part epoxy, or other thermally activated adhesive.

Figure 3B:
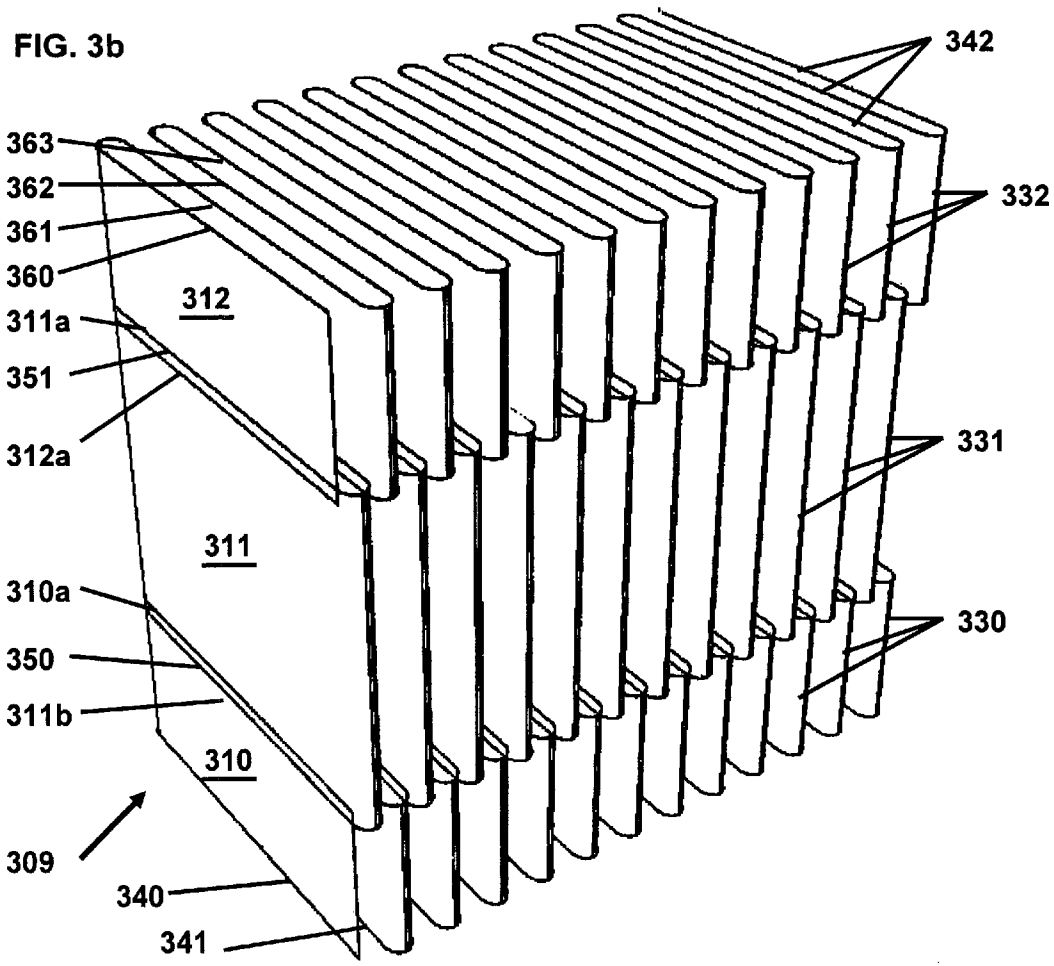
FIG. 3*b* illustrates counter-pleat core without the context of the housing structure.
Figure 3C:
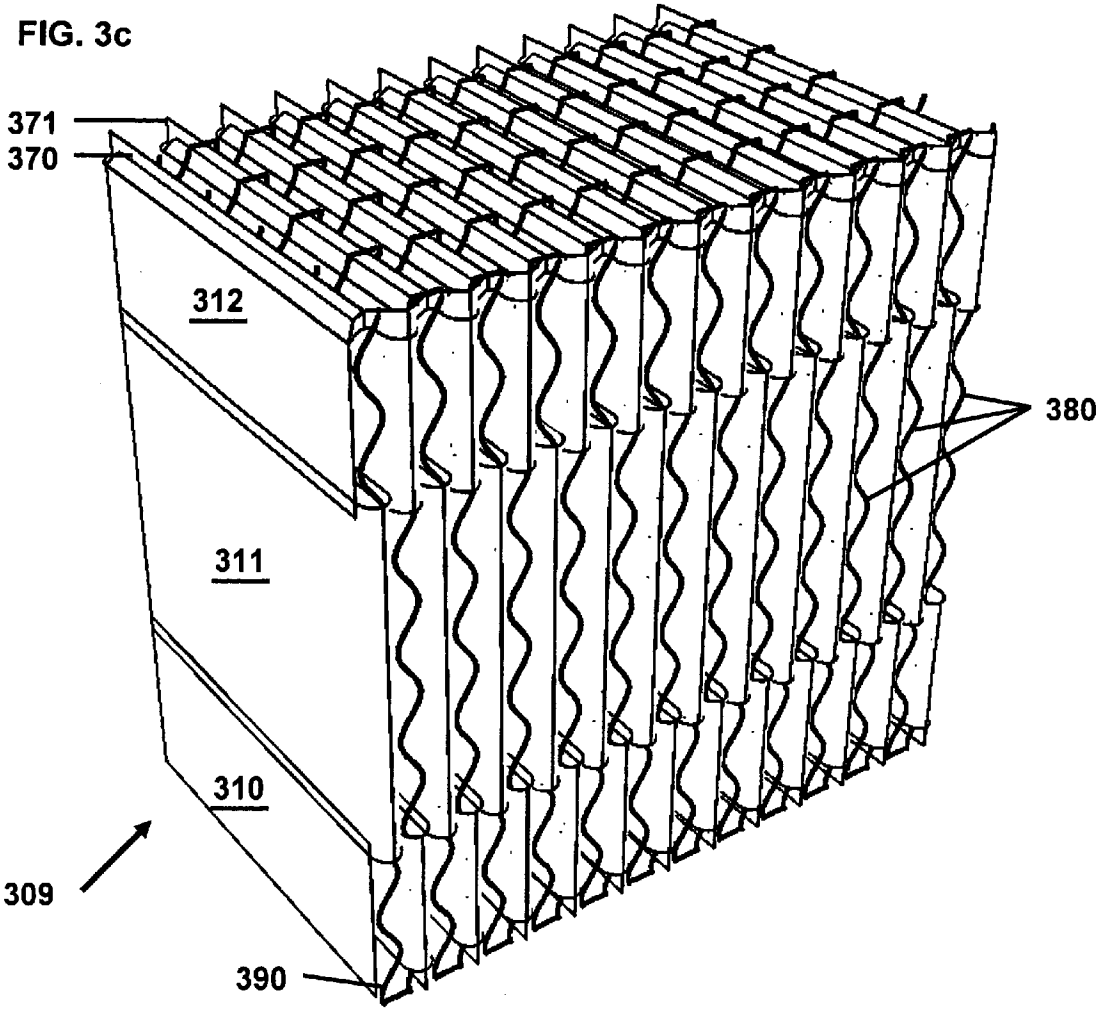
FIG. 3*c* illustrates counter-pleat core without the context of the housing structure, but including cross-pleated, continuous strip separators and alternately sealed membrane ends; and, FIG. 4 is a perspective view showing preferred embodiment of one layer of corrugated netting of thermoplastic material.

FIGS. 3*a-c* show perspective views illustrating a counter-flow exchanger constructed of three (3) continuous membrane strips (two or more membrane strips can be utilized). Specifically, FIG. 3*a* illustrates counter-flow exchanger with air stream flows, air stream separation, and counter-pleated membrane housing structure. An embodiment of a heat and water vapor exchanger 300, for transferring heat and vapor between first fluid streams 301*a* and 302*a* and second fluid streams 303*a* and 304*a*, the exchanger 300 comprising: a housing 306 with a first surface 390 containing a first plurality of inlet ports (320,322) and outlet port 321, and a substantially parallel opposing second surface 391 containing a second plurality of inlet ports (325,323) and outlet port 324. The first inlet ports (320,322) on first surface 390 are directly opposite second inlet ports (325,323) on second surface 391 and first outlet port 321 on first surface 390 are directly opposite second outlet port 324 on second surface 391. A counter-pleated membrane core 309 is generally enclosed within a housing 306. The folds of water-permeable membranes define inlet ports (322, 320, 325, 323) and outlet ports (321, 324) on first face 390 and second face 391 of counter-pleated core 309 and being substantially perpendicular to internal seams. All first inlets (322, 320) on first face 390 fluidly connect to second outlet 324 on second face 391 and wherein all second inlets (325, 323) on the second face 391 fluidly connect to first outlet 321 on the first face 390. Furthermore, all first inlet air flows (301*a*, 302*a*) entering first face 390 fluidly connect to second outlet air flows (301*b*, 302*b*) on second face 391 and wherein all second inlet air flows (303*a*, 304*a*) on the second face 391 fluidly connect to first outlet air flows (303*b*, 304*b*) on the first face 390.

FIG. 3*b* illustrates counter-pleat core 309 without the context of the housing structure (for example, 300 in FIG. 3*a*). The core 309 comprises multiple layers of folded, water-permeable membrane material defining a stack of alternating first and second fluid passageways, wherein each layer comprises a portion of at least two strips of said water-permeable membrane material (310, 311, 312) joined by one seam 351 for a first pair of two membrane strips (312, 311) and one additional seam 350 for additional strip 310. Membrane strip 312 has repeated 180° folds 332 creating a multiplicity of layers 342. Membrane strip 311 has repeated 180° folds 331 creating a multiplicity of layers 342. Membrane strip 310 has repeated 180° folds 330 creating a multiplicity of layers 342. Membrane strips 312, 311, and 310 are arranged edge-to-edge in the same plane. Membrane strip edge 312*a* overlaps membrane and is joined together with strip edge 311*a* resulting in membrane seam 351. Membrane strip edge 310*a* overlaps and is joined together with membrane strip edge 311*b* resulting in membrane seam 350. The seams (351, 350) joining the membrane strips are mostly internal within counter-pleated core 309 and substantially parallel to a direction of general airflow movement (for example, FIG. 3*a*).

Counter-pleated cores of the type described herein can further comprise separators positioned between the membrane layers, for example, to assist with fluid flow distribution and/or to help maintain separation of the layers. For example, corrugated netting of thermoplastic material, corrugated aluminum inserts, plastic molded inserts, or mesh inserts can be disposed in some of all the passageways between adjacent membrane layers. Separators may be inserted between the membrane layers after the core is formed or may be inserted during the counter-pleating process, for example between the steps shown in FIG. 2*a* and FIG. 2*b* and then again between FIG. 2*c* and FIG. 2*d* described above.

FIG. 3*c* illustrates counter-pleated core 309 without the context of the housing structure (for example, 306 in FIG. 3*a*), but including cross-pleated, continuous strip separators 380 and alternately sealed membrane ends 370, 371, and 372. Separators 380 are preferably woven at a 90° degree orientation to continuous membrane strips 312, 311, and 310; forming cross-pleated pattern. Preferably, separators 380 are oriented so that the corrugated channels are generally parallel to the inlet and outlet passageway into which they are inserted and oriented parallel to each other, to provide a counter-flow configuration. Furthermore, cross-pleated separators 380 can be locked in place through additional membrane edge sealing. This is advantageous because it also acts to replace "potting" resin on the top and bottom side of counter-pleated core 309. Referring to FIGS. 3*b-c*, edge 360 of membrane strip 312 is joined to edge 361 of membrane strip 312 forming edge bond 370. Similarly, edge 362 of membrane strip 312 is joined to edge 363 of membrane strip 312 forming edge bond 371. This pattern is repeated for all membrane layers 342 generated by the counter-pleated folds 332 of membrane strip 312, joining every other parallel edge of membrane strip 312 together. Preferred joining method involves impulse-type, thermally applied heat wherein continuous separator 380 partially melts, but does not break apart. Edge bonds 370, 371 and others are fashioned in a way to provide complete air-tight seal between airflow paths. Furthermore, edge 340 of membrane strip 310 is joined to edge 341 forming edge bond 390. This pattern is repeated for all membrane layers 342 generated by the counter-pleated folds 330 of membrane strip 310, joining every other parallel edge of membrane strip 310 together. Different separator designs can be used for the alternate layers, or at different locations in the cores—they need not all be the same.

Figure 4:
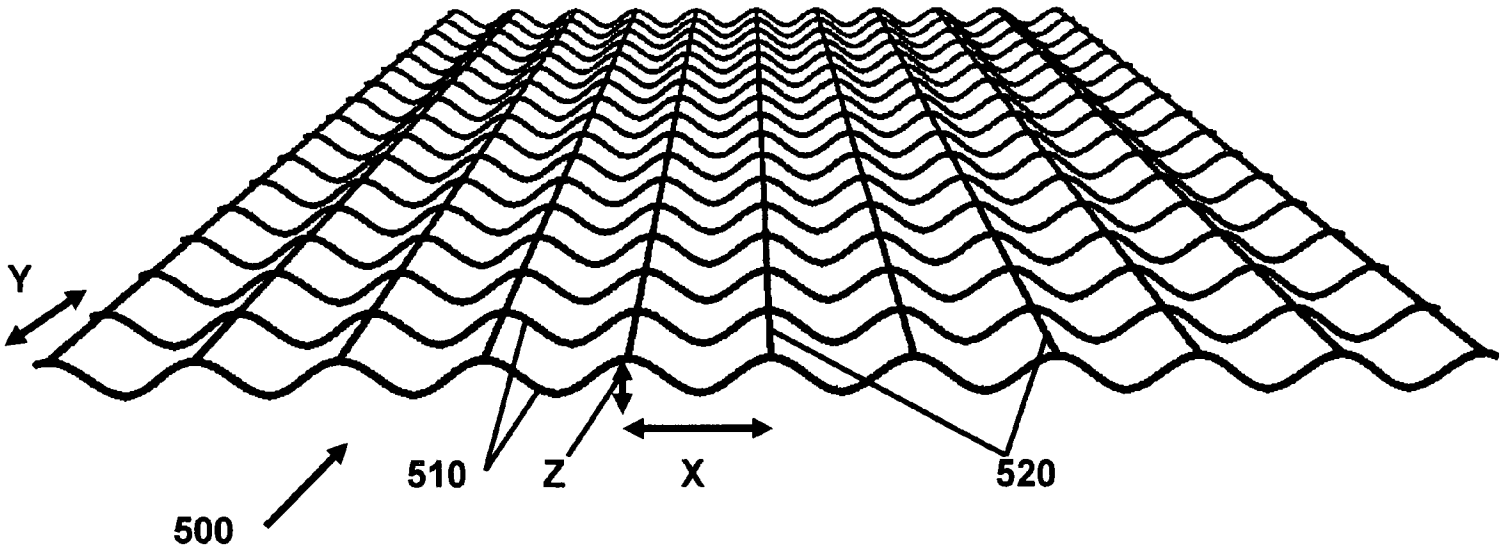

FIG. 4 is a perspective view showing one layer of corrugated netting composed with thermoplastic material 500. Netting material 500 is defined by sinusoidal pattern 510 on X plane with substantially straight connectors 520 at 90° angles along Y plane. Sinusoidal pattern 510 with amplitude of Z defines a discrete fluid flow channel within the context of heat and/or moisture exchangers. Plastic mesh apertures (hole sizes) are selected to produce the optimal combination of vapor transmission, pressure drop, and strength. Thermoplastic netting may be produced through an extrusion process. Furthermore, thermoplastic material 500 is preferably biaxial oriented netting which is lighter weight and more flexible than extruded square mesh. Orientation "stretches" extruded square mesh in X and Y directions under controlled conditions to produce strong, flexible, and light weight netting. Thermoplastic netting material is selected from a group consisting of polypropylene, polyethylene, or other thermoplastics with netting sheet weight of less than 3 lbs/1000 $ft^2$, preferably less than 1.5 lbs/1000 $ft^2$.

The above defined separator can be used in all current heat and moisture exchanger designs known in the prior art. Biaxial oriented mesh has superior performance over prior art heat and water vapor separator materials and techniques. The mesh apertures (hole size) presents more membrane surface area to the air stream and facilitates faster water vapor transfer over corrugated sheet materials such as foils, plastics, or paper. In addition, water vapor within an air stream will, on average, travel a shorter distance to interact with membrane than with sheet materials. Furthermore, biaxial oriented mesh facilitates fluid movement in both the X and Y plane directions where airflow entering corrugated sheet material travels only in a straight line path. Bi-directional airflow allows for a broader range of geometric shapes within the context of heat and moisture exchangers. Corrugated mesh utilizes less material than corrugated sheets, achieving both cost reduction as well as better performance in smoke/fire testing. Thermoplastic material is resistant to most forms of corrosion allowing for operation in air streams containing corrosive chemicals. Thermoplastic material is generally known to be compatible with most forms of heat and vapor membrane materials.

Membrane material used in counter-pleated cores of the type described herein can be selected to have suitable properties for the particular end-use application. Preferably the membrane is pliable or flexible mechanically such that it can be folded as described herein without splitting. Preferably the membrane will also form and hold a crease when it is folded, rather than tending to unfold and open up again. It is also advantageous that the membrane be of a washable variety so that cores can be completely submerged in cleaning solution. An additional property that is advantageous is the ability to thermally bond membranes using impulse style heating elements.

For energy recovery ventilators or other heat and water vapor exchanger applications, the membrane is water-permeable. In addition, more conventional water-permeable, porous membranes with a thin film coating, that substantially blocks gas flow across the membrane but allows water vapor exchange, can be used. Also porous membranes that contain one or more hydrophilic additives or coatings can be used. Porous membranes with hydrophilic additives or coatings can be used. Porous membranes with hydrophilic additives or coatings have desirable properties for use in heat and water vapor exchangers, and in particular for use in heat and water vapor exchangers with a counter-pleated membrane core. Preferably, membranes have favorable heat and water vapor transfer properties, are inexpensive, mechanically strong, dimensionally stable, easy to pleat, are bondable to gasket materials such as polyurethane, are resistant to cold climate conditions, and have low permeability to gas cross-over when wet or dry. The membrane should be unaffected by exposure to high levels of condensation (high saturation) and under freeze-thaw conditions.

Asymmetric membranes that have different properties on each surface can be used. If the two asymmetric membrane strips are oriented the same way in the manufacturing process, one set of passageways in the finished counter-pleated core will have different properties than the alternating set of passageways. For example, the membrane strips could be coated or laminated on one side so that the passageways for just one of the two fluid streams are lined by the coating or laminate.

External profiles or features can be added to or incorporated into the membrane to enhance fluid distribution between the layers and/or to help maintain separation of the layers. Ribs or other protrusions or features can be molded, embossed or otherwise formed integrally with the membrane material, or can be added to the membrane afterwards, for example by a deposition or lamination process. Such membranes can be used in counter-pleated cores of the type described herein with or without the use of additional separators.

Counter-pleated cores of the type described herein can comprise more than one type of membrane. For example, in some embodiments, instead of using two strips or reels of membrane that are essentially the same, two different types of membrane can be used. This will result in a counter-pleated core where each layer comprises two different membrane types.

Counter-pleated cores of the type described herein can also be formed so that a portion of the core is devoted to heat transfer only while the remaining portion is devoted to both heat and moisture transfer. This arrangement is advantageous in extremely cold climates where the sensible portion of the plate provides a "pre-heating" effect to the incoming fresh air stream and thus reduces possibility of sub-freezing condensation conditions. A "hybrid" counter-pleated core can be manufactured by partially dipping a portion of the core into a solution that will block the porous nature of respective membrane.

A counter-pleating process of the type described in references to FIGS. 2*a-f* can be performed manually or can be partially or fully automated for volume manufacturing.

As can be seen from FIGS. 2*a-f*, there is no waste in the manufacturing process associated with counter-pleating technique. All of the membrane is used. Also, in the finished core almost the entire membrane surface is accessible to the fluids that are directed through the core and available to provide the desired fluid and/or heat transport.

The present counter-pleated membrane core can be used in various types of heat and water vapor exchangers. For example, as mentioned above, the present counter-pleated membrane cores can be used in energy recovery ventilators for transferring heat and water vapor between air streams entering and exiting a building. This is accomplished by flowing the streams on opposite sides of the counter-pleated membrane core. The membrane allows the heat and moisture to transfer from one stream to the other while substantially preventing the air streams from mixing or crossing over.

Other potential applications for the counter-pleated cores of the type described herein include, but are not limited to:

1) Fuel cell humidifiers where the counter-pleated cores comprises a water-permeable membrane material. For this application the humidifier is configured to effect heat and water vapor transfer from and/to a fuel cell reactant or product stream. For example, it can be used to recycle the heat and water vapor from the exhaust stream of an operating fuel cell transferring latent and sensible energy from one stream to another.

2) Remote energy recovery where an exhaust air stream is located remotely and distinctly from a supply air stream. For this application, two or more independent, counter-pleated cores separated by a distance would be joined by a pumped run-around piping system. One of two distinct air passages per core would be replaced with a liquid, affecting an air-to-liquid-to-air transfer. Heat and water vapor would be transferred through pumped liquid to remote and distinctly separate core(s). A multitude of different counter-flow cores are envisioned connecting a multitude of distinctly separator supply and exhaust air streams.

3) Flue gas recapture or filter devices. Flue gas is an exhaust gas that exits to the atmosphere via a flue from a fireplace, oven, furnace, direct-fire burner, boiler, steam generator, power plant, or other such source. Quite often, it refers to the combustion exhaust gas produced at power plants. A counter-pleated core can be used to recapture or filter flue gases, water vapor and heat, with a high quality seal thereby limiting toxic gas leakage. Advantages of such configuration would eliminate liquid condensation and produce clean, heated, and humidified supply air to an application.

4) Sequestering (carbon). A counter-pleated core can comprise a layer of sequestering material, for example, in alternate membrane layers to transfer, absorb, or trap heat, water vapor, materials, or contaminants.

5) Dryers where a counter-pleated core is used in drying of gases by transfer of water from one stream to another through a water-permeable membrane.

6) Gas/liquid separators where the counter-pleated core comprises a membrane material that promotes the selective transfer of particular gases or liquids.

7) Gas filtering, where the counter-pleated core comprises a membrane material that promotes the selective transfer of particular gas, and can be used to separate that gas from other components.

Other membrane materials (thin sheets or films) besides selectively permeable membrane materials could be pleated to form cores, using the counter-pleating technique described herein, for a variety of different applications. For example, pliable metal or foil sheets could be used for heat exchangers, and porous sheet materials could be used for other applications such as filters. In addition, a hybrid sheet where one part is heat transfer only and one part where moisture transfer is allowed is also envisioned.

The preferred orientation of the core will depend upon the particular end-use application. For example, in many applications an orientation with vertically oriented passageways may be preferred (for example, to facilitate drainage); in other applications it may be desirable to have the passageways layered in a vertical stack; or functionally it may not matter how the core is oriented. More than one core can be used in series or in parallel, and multiple cores can otherwise enclosed in a single housing, stacked or side-by-side. Manifolds of various sizes and made out of various materials can be added to facilitate a number of flow configurations.

While particular elements, embodiments, and applications of the present invention have been shown and described, it will be understood that the invention is not limited thereto since modifications can be made by those skilled in the art without departing from the scope of the appended claims, particularly in light of the foregoing teachings.

I claim:

1. A counter-flow heat and water vapor exchanger for transferring thermal energy and moisture between a first fluid stream and a second fluid stream, the exchanger comprising:

a housing with a first surface containing a first plurality of inlet ports and outlet ports, and a substantially parallel opposing second surface containing a second plurality of inlet ports and outlet ports, wherein said first inlet ports on said first surface are directly opposite said second inlet ports on said second surface and said first outlet ports on said first surface are directly opposite said second outlet ports on said second surface;

a counter-pleated core enclosed within said housing, said counter-pleated core comprising multiple layers of a folded water-permeable membrane material defining a stack of alternating first and second fluid passageways, wherein each layer comprises a portion of at least two strips of said water-permeable membrane material joined by one seam for a first pair of two of said strips and one additional seam for each additional strip, said seams joining said membrane strips being internal within said counter-pleated core and substantially parallel to a direction of general airflow movement, folds of said water-permeable membrane defining said inlet and said outlet ports on first and second faces of said counter-pleated core and being substantially perpendicular to said seam(s);

wherein all said first inlets on said first face fluidly connect to all said second outlets on said second face and wherein all said second inlets on the second face fluidly connect to all said first outlets on the first face.

* * * * *